US005880747A

United States Patent [19]

Bartenwerfer et al.

[11] Patent Number: 5,880,747

[45] Date of Patent: Mar. 9, 1999

[54] DEVICE FOR PRINTING TO STOCK STANDING ON EDGE

[75] Inventors: Christian Bartenwerfer; Frank Geserich; Wolfgang Von Inten; Wilfried Kopanski; Wolf-Alexander Krumholz; Matthias Lorenzen; Dietrich Müller; Heinz Rehberg, all of Berlin; Michael Schmidt-Kretschmer, Eichwalde; Dieter Wölm, Gross Schulzendorf; Michael Wolf, Potsdam, all of Germany

[73] Assignee: Francotyp-Postalia Aktiengesellschaft und Co., Birkenwerder, Germany

[21] Appl. No.: 791,630

[22] Filed: Jan. 31, 1997

[30] Foreign Application Priority Data

Jan. 31, 1996 [DE] Germany ..... 196 05 014.6
Oct. 25, 1996 [DE] Germany ..... 196 45 303.8

[51] Int. Cl.[6] ..... B41J 3/04

[52] U.S. Cl. ..... 347/4; 347/37

[58] Field of Search ..... 347/2, 3, 4, 153, 347/154, 37; 101/91

[56] References Cited

U.S. PATENT DOCUMENTS 5,025,386 6/1991 Pusic ..... 364/478
5,467,709 11/1995 Salomon ..... 101/93

FOREIGN PATENT DOCUMENTS 0 622 227 A2 11/1994 European Pat. Off. .

*Primary Examiner*—Nancy Le
*Assistant Examiner*—Anh T.N. Vo
*Attorney, Agent, or Firm*—Herbert L. Lerner; Laurence A. Greenberg

[57] ABSTRACT

A device for printing stock standing on one edge, in particular a piece of mail in a postage meter and/or addressing machine, includes a guide plate for the stock which is inclined relative to the vertical and has a recessed region for a printing device. A rotating conveyor has a conveying plane which extends orthogonal to the guide plate and on which the stock stands on one edge and is transported in one direction while resting against the guide plate. The recessed region includes at least one cutout and a region of the guide plate downstream of the cutout is so far recessed from a bearing surface for the stock that there is no contact with the latter in this location. This ensures sufficient penetration time for the ink and prevents smearing of the printed image. The printing device is an ink jet printing device which is stationary during printing and which has a nozzle plane that extends parallel to the guide plate. The guide plate is inclined a maximum of 45° from vertical. The conveyor runs continuously. This structure simplifies transport of the piece of mail, improves the printing technology and ensures a clean printed image at high throughput.

17 Claims, 6 Drawing Sheets

DEVICE FOR PRINTING TO STOCK STANDING ON EDGE

BACKGROUND OF THE INVENTION

1. Field of the Invention

The invention relates to a device for printing to stock standing on edge, in particular a piece of mail in postage meters and/or addressing machines.

With such devices, the stock is guided past a printing device and the postage indicia or address is printed in a single pass.

The stock is typically guided past the printing device while lying flat as is seen in U.S. Pat. No. 5,467,709, for example, or on edge as is seen in U.S. Pat. No. 5,025,386, for example.

In each case, it is important to ensure that the stock and the printing device are brought into a defined position relative to one another so that the impression is printed in the intended location and with sufficient quality.

In the case of a horizontal transport of the stock, a relatively large bearing surface, corresponding to the largest stock format to be printed, is required and thus the machine has a correspondingly large footprint.

In the device disclosed in U.S. Pat. No. 5,467,709, an ink jet print head provides contactless printing. The piece of mail is fed between a driven conveyor and spring-mounted pressure rollers, whereby the piece of mail rests against a longitudinal guide plate. The longitudinal guide plate has a cutout matching the conveyor and a rectangular cutout for the ink jet print head. The nozzles of the print head run along the diagonal of the cutout. The conveyor, the longitudinal guide plate and the ink jet print head are located above the piece of mail. The spring-mounted pressure rollers and a spring-mounted pressure roller located in the print area are located below the piece of mail. The travel of the pressure rollers and the pressure plate corresponds to the maximum piece of mail thickness, which can vary between 2 mm and 20 mm. The spring force must be appropriate for the entire range of weights of pieces of mail, that is approximately 20 to 1000 g, and must also ensure that the piece of mail is held sufficiently planar in the area of the cutout for the print head. Contactless ink jet printing requires that the smallest possible distance be maintained between the stock and the ink jet print head. That both minimizes the effects of inaccurate ink spray and prevents the stock from contacting the nozzle surface, thus preventing smearing.

However, there is still a risk of smearing when the piece of mail leaves the area of the cutout and inevitably glides along the longitudinal guide plate.

Those conditions are difficult to maintain when rapidly processing pieces of mail of varying dimensions.

The prior art also discloses a postage meter as is seen in the above-mentioned U.S. Pat. No. 5,025,386, in which the piece of mail is carried on edge and slightly inclined on a rotating conveyor. The pieces of mail rest against a guide plate which has a print window. A thermal print head with which the postage indicia is printed on the piece of mail can be moved laterally and vertically within the print window. The size of the print window must be adapted to the maximum length and width of the printed image. The individual piece of mail is transported to the print window, then stopped and pressed through the use of a pressure plate against the guide plate or the print window. It is only then that printing can begin.

The pressure plate is driven by a motor through a toothed gearing and crankshaft. That is a relatively complex mechanism and significant counterpressure must also be provided for thermal printing.

After printing, the piece of mail is released and transported away.

It is clear that only a low throughput is possible with such an intermittent mode of operation. Positioning of the thermal print head is complex.

SUMMARY OF THE INVENTION

It is accordingly an object of the invention to provide a device for printing stock standing on edge, which overcomes the hereinafore-mentioned disadvantages of the heretofore-known devices of this general type and which provides simplified transport of a piece of mail and improved printing technology, while ensuring a clean printed image at a high throughput.

With the foregoing and other objects in view there is provided, in accordance with the invention, a device for printing stock standing on one edge, in particular a piece of mail in postage meters and/or addressing machines, comprising a guide plate inclined relative to the vertical by at most 45°, the guide plate having a downstream end as seen in a stock transport direction, a recessed region with at least one cutout, a region following the at least one cutout toward the downstream end at which the stock is free of contact; an ink jet printing device disposed at the recessed region and being stationary during printing, the ink jet printing device having a nozzle plane extending parallel to the guide plate; and means or a device for applying an advancing force to the stock to advance it along the guide plate in the transport direction.

The use of an ink jet print head enables continuous transport and printing. Since printing is contactless, the bearing force arising from the inclination of the guide plate and the conveyor is sufficient to ensure a defined print head position. Friction on the guide plate can be minimized through the use of a correspondingly smooth surface and/or sliding rails.

In accordance with another feature of the invention, the configuration of the region of the guide plate downstream of the print area or the cutout ensures that the stock is not supported at that location. This ensures a sufficiently long penetration time, which is also referred to as an absorption time, for the ink, thus preventing smearing of the printed image. The fact that the nozzle plane is recessed relative to the region upstream of the cutout and that the downstream region is even farther recessed or open, prevents the stock from catching on one of the edges.

In accordance with a further feature of the invention, the region of the guide plate downstream of the cutout is either itself cut away or recessed relative to the bearing surface for the stock by an amount which is greater than the greatest expected convexity of the stock in the printed area. This clearance is achieved either by mechanical shaping, such as through the use of the mold in the case of plastic injection molding, or through the use of some metal removing process. In the latter two variants, this amounts to only a few tenths of a millimeter, but can be as much as two millimeters to achieve the desired graduated recess.

In accordance with an added feature of the invention, there are provided sliding rails running in the direction of transport on the guide plate, which greatly reduces the bearing surface for the pieces of mail and thus the friction.

In accordance with an additional feature of the invention, the aforementioned unsupported region for the printed area of the stock is easily realized by placing the sliding rails farther apart than the printed image is wide and thicker than the greatest expected convexity of the stock.

In accordance with yet another feature of the invention, there is provided an insert of stainless steel to realize the structured portion of the guide plate, which provides several advantages. This insert can be stamped or cut to size from a piece of sheet metal. Stainless steel can be highly polished, resists abrasion and has good sliding properties.

The guide plate and the conveyor form a 90° angle. By superimposing imaginary coordinate axes over the device with the x axis extending in the direction of transport or along the length of the conveyor, the z axis across the width of the conveyor and the y axis from the bottom to the top of the guide plate, one can see that the z and x position of the stock is easily maintained.

The guide plate is inclined at some angle greater than 90° so that the stock is securely supported yet abrasion is negligible.

In accordance with yet a further feature of the invention, the angle of inclination is preferably $\alpha$=18° from the vertical relative to the zx plane. This minimizes the forces acting on the stock and provides a high degree of positional stability. Depending on the friction pairing, a range from greater than 90° to 135° is also possible.

In accordance with yet an added feature of the invention, if the postage indicia and address are to be printed in a single pass, an ink jet print head can still be used but an appropriate positioning mechanism for the print head is then required.

In accordance with yet an additional feature of the invention, if there is a separate ink jet print head for each cutout or print function, not only is there no need for a positioning mechanism, but different colored inks can also be used, such as red for the postage indicia and black for the address.

In accordance with a concomitant feature of the invention, mounting an incremental transducer connected to the drive roller on a common axis and the use of a synchronous belt as the conveyor ensures precise monitoring of the conveying distance and precise, no-slip transmission of motion.

Other features which are considered as characteristic for the invention are set forth in the appended claims.

Although the invention is illustrated and described herein as embodied in a device for printing to stock standing on edge, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 3*a,* 3*b* and 3*c* show a device having a guide plate with an insert, in which FIG. 3*a* is a perspective view of a complete device.

DESCRIPTION OF THE PREFERRED EMBODIMENTS

Figure 1:
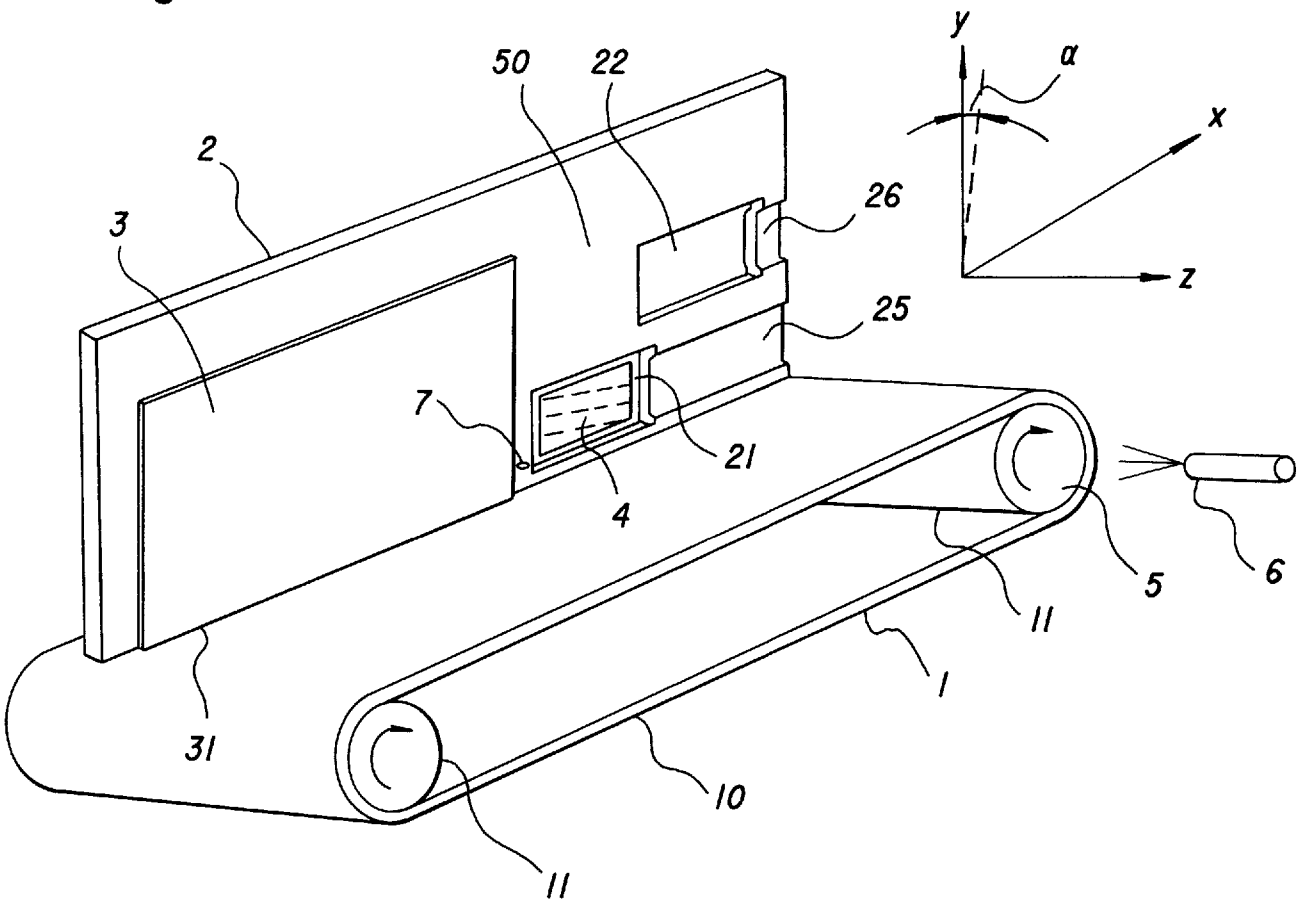
FIG. 1 is a diagrammatic, perspective view of a device according to the invention having a smooth guide plate.

Referring now in detail to the figures of the drawings, which are partly diagrammatic for reasons of simplicity and better comprehension, and first, particularly, to FIG. 1 thereof, there is seen a device according to the invention for printing stock (referred to below as a piece of mail) 3 standing on one edge 31. The device essentially includes a conveyor 1, a guide plate 2 located orthogonal to and above a transport plane and an ink jet print head 4. A sensor 7 is used to detect a front edge of a piece of mail and trigger printing.

The conveyor 1 includes a belt 10 and two rollers 11. One of the rollers 11 is a drive roller. Means for applying an advancing force to the stock to advance it along the guide plate in the transport direction may be provided by the conveyor 1 or any other suitable device. Both rollers 11 are preferably realized in a non-illustrated manner as toothed wheels and the belt 10 is correspondingly realized as a synchronous belt. This ensures a precise transmission of force.

The drive roller 11, together with an incremental transducer 5, is mounted so as to be stationary on an axle, which is likewise not shown. The incremental transducer 5 is realized as a slotted disk which is illuminated by a photocell 6, for example.

The guide plate 2, against which one surface 32 of the stock 3 rests, is preferably inclined at an angle $\alpha$=18° from the vertical. The guide plate 2 and the conveyor 1 form a 90° angle. The pieces of mail 3 on the conveyor 1 inevitably rest against the guide plate 2 due to the inclination of the same.

With the conveyor 1 in motion, the pieces of mail 3 glide along the stationary guide plate 2.

The guide plate 2 has a first cutout 21 for the ink jet print head 4 and a second cutout 22 for the same or for another ink jet print head 4.

Postage indicia is printed through the cutout 21 and an address through the cutout 22.

Regions 25 and 26 of the guide plate 2 which are respectively disposed downstream of the cutouts 21 and 22 are recessed relative to bearing surfaces 50 for the piece of mail 3 by such an amount as to ensure that there is no contact with the printed surface. In this case, the recess is created by bending the guide plate 2 at right angles.

Figure 2A:
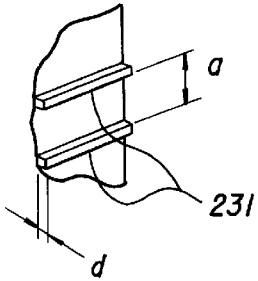
FIG. 2 is a perspective view of a device according to the invention having a guide plate with sliding rails.
Figure 2:
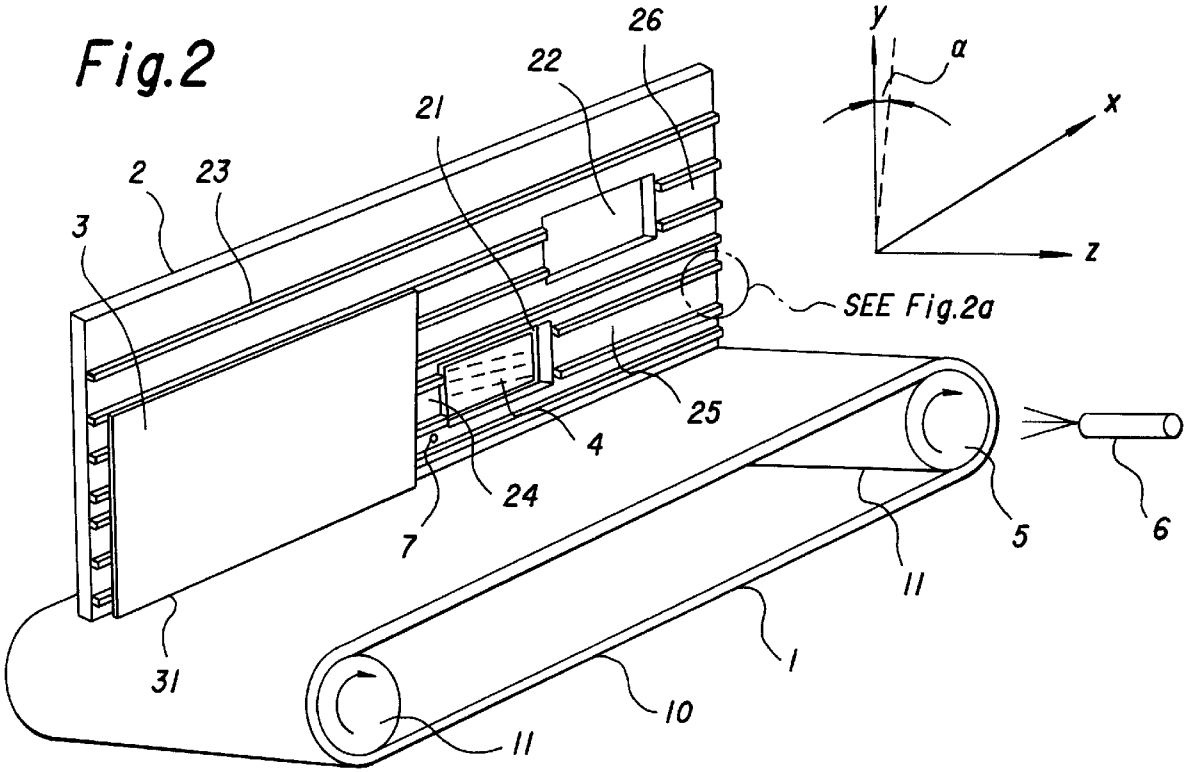

In the device shown in FIG. 2, the guide plate 2 is equipped with sliding rails 23, 231 running parallel to the direction of transport in order to improve the sliding characteristics. As in the first embodiment, there are two cutouts 21, 22 in the rear section of the guide plate 2. The cutout 21 is at a height at which the postage indicia is to be printed. The cutout 22 is at a height at which the address is to be printed.

The ink jet print head 4 is disposed in the cutout 21 in such a manner that its nozzle surface is parallel to the guide plate 2 and a distance to the conveyed piece of mail is approximately 1 to 2 mm. The sensor 7 for detecting the front edge of a piece of mail is mounted just upstream of the cutout 21 and interacts with the incremental transducer 5 to issue a print command.

Figure 5:
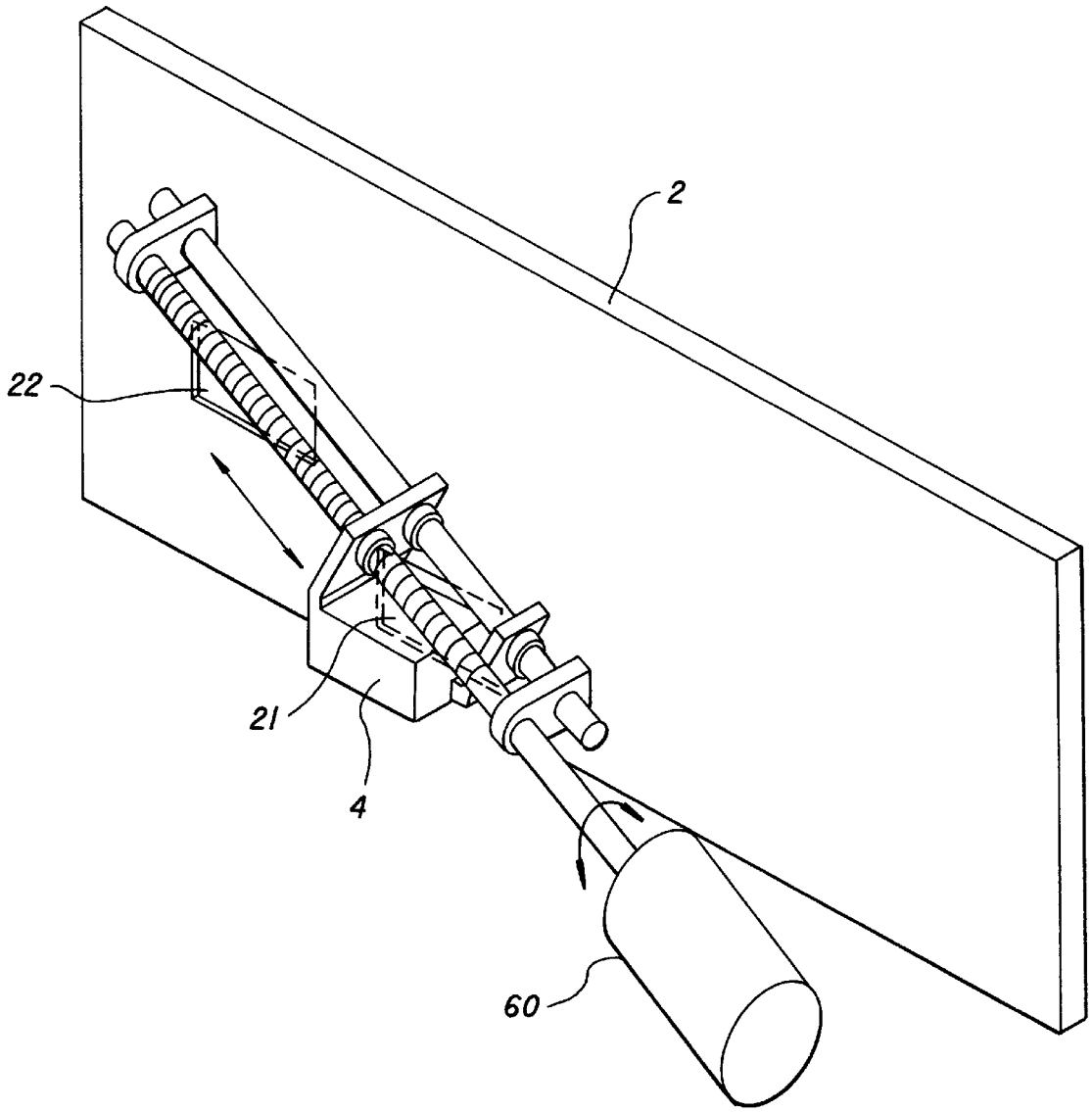
FIG. 5 is a perspective view of an ink jet print head moving device.

There can be a separate ink jet print head 4 permanently mounted in each cutout or a single ink jet print head 4 can be moved from one cutout to the other by the ink jet print head moving device 60 as shown in FIG. 5. While this saves the cost of a second ink jet print head, it also increases the kinematic complexity of the device.

In the regions 25, 26 of the guide plate downstream of the cutouts 21, 22, the sliding rails 231 are separated by a distance a which is greater than a width of the printed image. A thickness d of the sliding rails 231 is greater than the greatest expected convexity of the piece of mail 3. A distance a >25 mm and a thickness d=2 mm are sufficient.

Figure 3A:
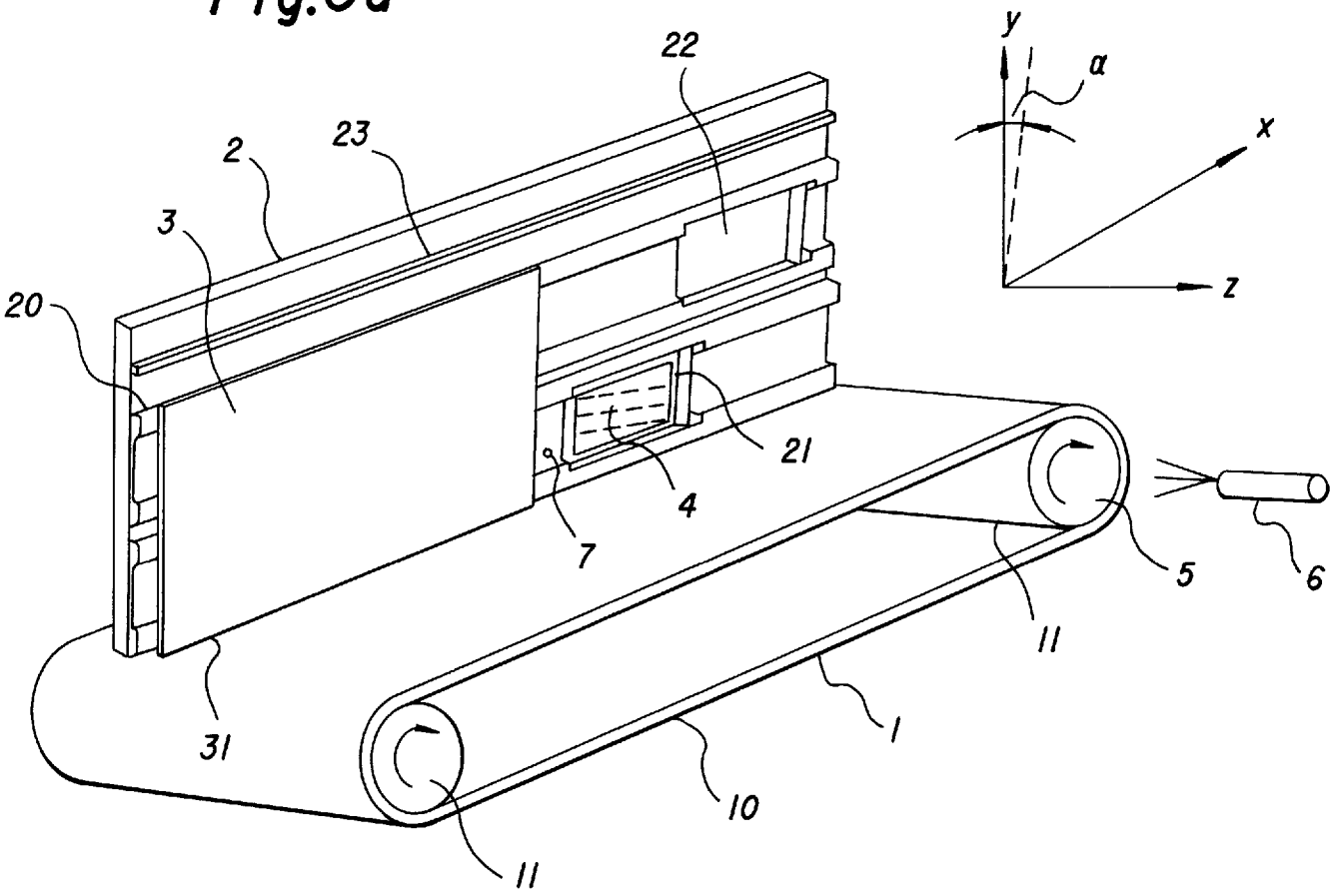

In a device shown in FIG. 3*a*, the guide plate 2 is equipped with an insert 20 in a primary support and printing area for the piece of mail 3.

Figure 3B:
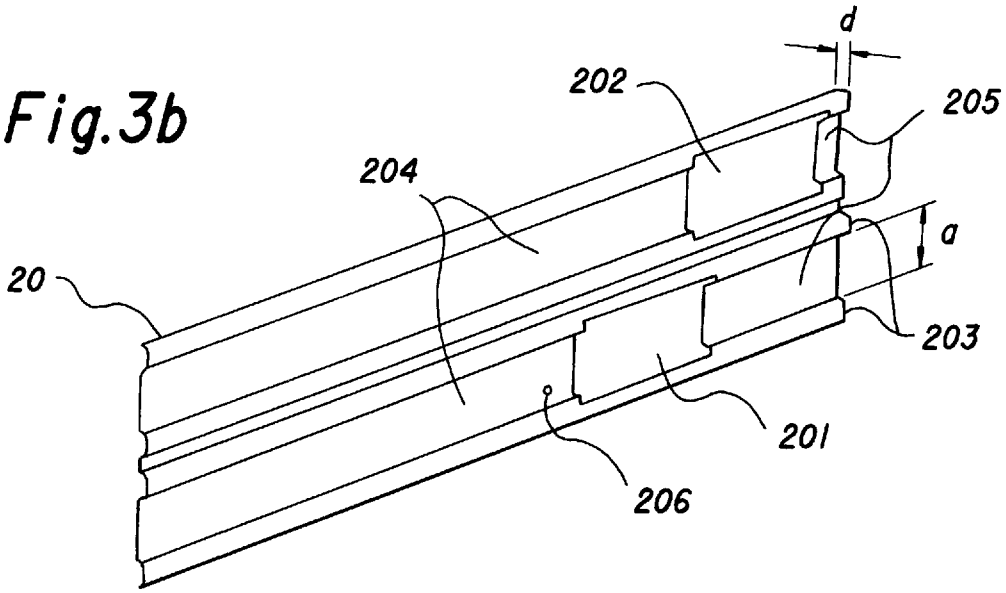
FIG. 3*b* is a perspective view of the insert.

The insert 20 is appropriately made of a piece of stainless steel into which all of the necessary structures have been stamped or cut (as is seen in FIG. 3*b*).

Sliding rails 203 extending over the entire length of the insert 20 are located above and below cutouts 201, 202 for the ink jet print head 4. An opening 206 is provided for the sensor 7.

Figure 3C:
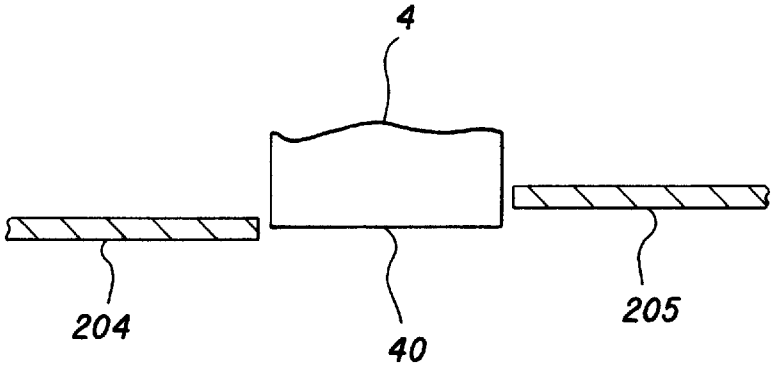
FIG. 3*c* is a fragmentary, longitudinal-sectional view of a print area.

In order to ensure reliable transport of the piece of mail, in particular to prevent jamming due to interlocking, a region 204 upstream of the cutouts 201, 202, a nozzle plane 40 of the ink jet print head 4 and a region 205 downstream thereof are progressively recessed (as is seen in FIG. 3*c*).

Realization is unproblematic if the insert 20 is manufactured from an appropriate deep-drawing sheet steel.

Figure 4:
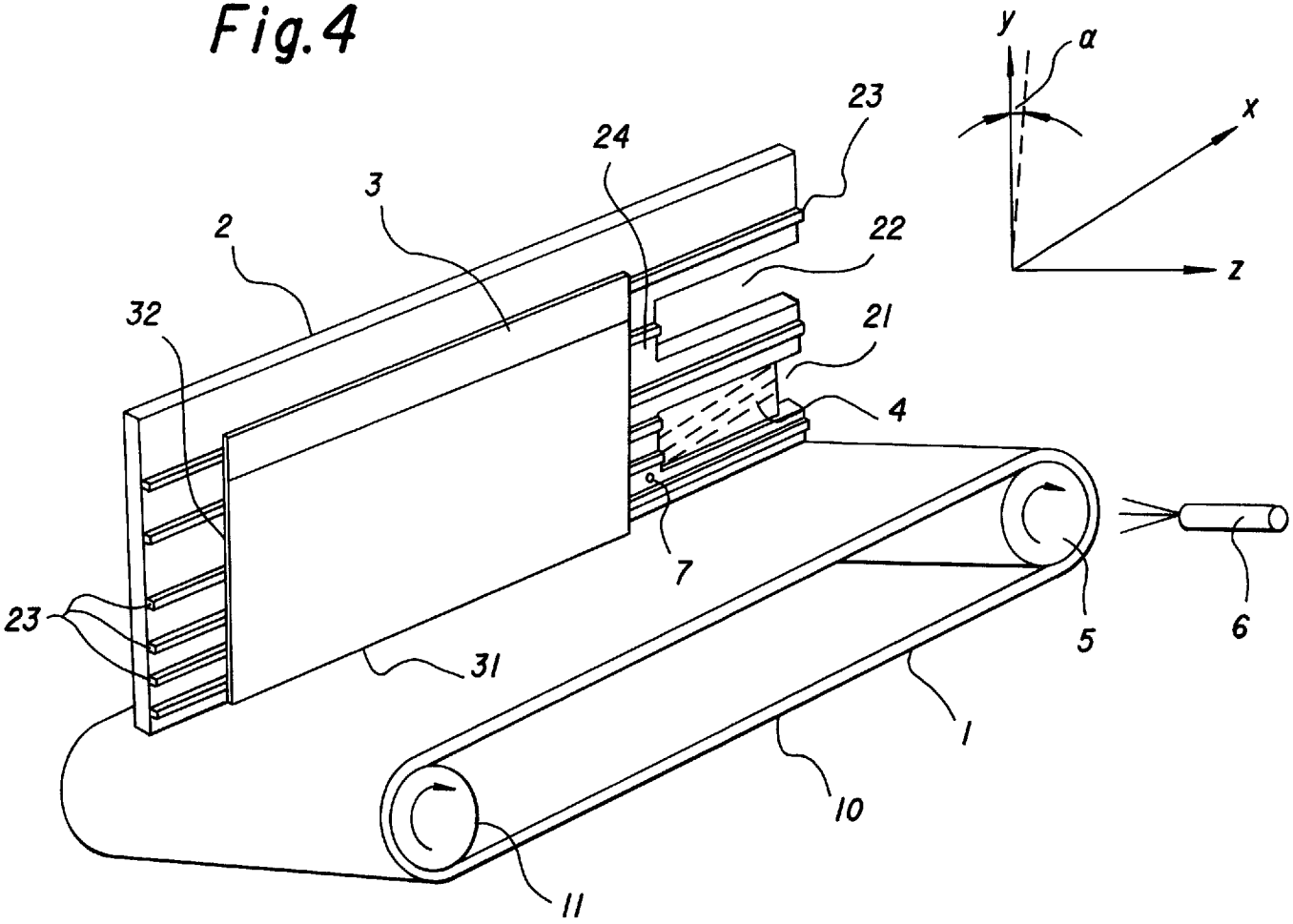
FIG. 4 is a perspective view of a device according to the invention with cutouts that are open to the rear.

In a device shown in FIG. 4, the guide plate 2 has cutouts 21, 22 which are open on their downstream ends relative to the direction of transport. This simple measure prevents smearing of the printed image and also prevents the piece of mail from catching.

We claim:

1. A device for printing stock, comprising:

a guide plate inclined relative to a vertical direction up to 45°, said guide plate having a downstream end in a stock transport direction, a recessed region with at least one cutout, and a further recessed region following said at least one cutout toward said downstream end at which stock being free of contact;

an ink jet printing device disposed at said recessed region and being stationary during printing, said ink jet printing device having a nozzle plane extending parallel to said guide plate; and an advancing device for advancing the stock along said guide plate in the transport direction.

2. The device according to claim 1, wherein said advancing device is a rotating conveyor on which the stock stands on edge and is conveyed in the transport direction while resting against said guide plate due to an own weight of the stock, and said rotating conveyor has a conveying plane extending orthogonal to said guide plate.

3. The device according to claim 1, wherein said guide plate has bearing surfaces and said further recessed region of said guide plate downstream of said at least one cutout is recessed relative to said bearing surfaces.

4. The device according to claim 3, wherein said further recessed region of said guide plate downstream of said at least one cutout is recessed relative to said bearing surface by a depth of 2 mm.

5. The device according to claim 1, wherein said at least one cutout of said recessed region has said downstream end relative to the stock transport direction and said at least one cutout of said recessed region is formed with an opening at least at said downstream end.

6. The device according to claim 1, wherein said guide plate is a planar plate against one surface of the stock while the stock stands on one edge on said advancing device.

7. The device according to claim 6, wherein said guide plate has sliding rails extending in the transport direction, and said sliding rails in said regions downstream of said at least one cutout are separated by a distance greater than a width of a printed image and have a thickness greater than a convexity of the stock in a printed area.

8. The device according to claim 1, wherein said guide plate has a stainless steel insert with at least one insert cutout and integral sliding rails.

9. The device according to claim 1, wherein said guide plate has a polished bearing surface for guiding the stock.

10. The device according to claim 8, wherein said stainless steel insert has a polished bearing surface for guiding the stock.

11. The device according to claim 1, wherein said guide plate has an upstream region of said at least one cutout of said recessed region, and said upstream region of said at least one cutout of said recessed region, said nozzle plane of said ink jet printing device and said further recessed region are progressively recessed.

12. The device according to claim 1, wherein the inclination of said guide plate relative to the vertical direction is 18°.

13. The device according to claim 1, wherein said recessed region has two cutouts, and said ink jet printing device has two ink jet print heads each disposed in a respective one of said cutouts of said recessed region and said further recessed region.

14. The device according to claim 1, including a positioning mechanism for moving said ink jet printing device, said recessed region has two cutouts, and said ink jet printing device has a single ink jet print head to be moved between said two cutouts and to be positioned laterally and vertically by said positioning mechanism.

15. The device according to claim 1, wherein said advancing device is a rotating conveyor including an axle, an incremental transducer mounted on said axle, two toothed rollers and a synchronous belt disposed around said two toothed rollers, and one of said toothed rollers is a drive roller also mounted on said axle and connected to said incremental transducer.

16. The device according to claim 1, wherein the stock is a piece of mail and the device is part of at least one of a postage meter and an addressing machine.

17. A device for printing stock standing on one edge, comprising:

a guide plate inclined relative to a vertical direction up to 45°, said guide plate having a downstream end in a stock transport direction, a recessed region with at least one cutout, a further recessed region following said at least one cutout toward said downstream end at which stock being free of contact;

an ink jet printing device disposed at said recessed region and being stationary during printing, said ink jet printing device having a nozzle plane extending parallel to said guide plate; and means for advancing the stock along said guide plate in the transport direction.

* * * * *